US006773666B2

(12) United States Patent
Lin et al.

(10) Patent No.: US 6,773,666 B2
(45) Date of Patent: Aug. 10, 2004

(54) AL-SI-MG-MN CASTING ALLOY AND METHOD

(75) Inventors: Jen C. Lin, Export, PA (US); Que-Tsang Fang, Export, PA (US); Carl E. Garesche, Streetsboro, OH (US); Holger Haddenhorst, Gelsenkirchen (DE)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 10/376,913

(22) Filed: Feb. 27, 2003

(65) Prior Publication Data

US 2004/0011437 A1 Jan. 22, 2004

Related U.S. Application Data

(60) Provisional application No. 60/361,019, filed on Feb. 28, 2002.

(51) Int. Cl.[7] ..... C22C 21/02
(52) U.S. Cl. ..... 420/546; 420/548; 420/544
(58) Field of Search ..... 420/544, 546, 420/548

(56) References Cited

U.S. PATENT DOCUMENTS

| | | | | |
|---|---|---|---|---|
| 4,609,031 A | | 9/1986 | Sasaki | 164/270.1 |
| 5,120,354 A | | 6/1992 | Ichiki | 75/568 |
| 5,537,969 A | | 7/1996 | Hata et al. | 123/193.2 |
| 5,588,477 A | | 12/1996 | Sokol et al. | 164/34 |
| 5,669,990 A | | 9/1997 | Adachi et al. | 148/420 |
| 5,837,070 A | * | 11/1998 | Sainfort et al. | 148/552 |
| 5,989,495 A | | 11/1999 | Isayama et al. | 420/535 |
| 6,070,643 A | | 6/2000 | Colvin | 164/61 |
| 6,148,899 A | | 11/2000 | Cornie et al. | 164/65 |
| 6,311,759 B1 | | 11/2001 | Tausig et al. | 164/113 |

* cited by examiner

*Primary Examiner*—George Wyszomierski
*Assistant Examiner*—Janelle Combs-Morillo
(74) *Attorney, Agent, or Firm*—Gary P. Topolosky; Edmond S. Miksch

(57) ABSTRACT

An improved Al—Si—Mg—Mn casting alloy that consists essentially of: about 6.0–9.0 wt. % silicon, about 0.2–0.8 wt. % magnesium, about 0.1–1.2 wt. % manganese, less than about 0.15 wt. % iron, less than about 0.3 wt. % titanium and less than about 0.04 wt. % strontium, the balance aluminum. Preferrably, this casting alloy is substantially copper-free, chromium-free and beryllium-free.

20 Claims, 5 Drawing Sheets

LOCATIONS (TWO CIRCLES) WITH DENSITY OF BLISTERS

LOCATIONS (TWO CIRCLES) WITH DENSITY OF BLISTERS

SAMPLING LOCATIONS (1-9) FOR TENSILE PROPERTIES

DIE SOLDERING / STICKING INDEX

FATIGUE CRACK PROPAGATION DATA FOR ALUMINUM CAST ALLOYS
D357-T6 AND C60K-T6 AT R=+0.1

NOTE:
WRIGHT LABORATORY DATA IS IN LAB AIR.
ALCOA DATA IS IN HIGH HUMIDITY AIR (RH>90%)

BOTH WRIGHT LAB AND ALCOA DATA HAVE VARYING DEGREES OF RESIDUAL STRESS THUS COMPROMISING RESULTS AND SUBSEQUENT COMPARISONS

SMOOTH (Kt=1) AXIAL STRESS FATIGUE DATA FOR D357-T6
AND C60K-T6 CASTING AT R = +0.1, LAB AIR

SUPPLIER A,B,C:
SMOOTH SPECIMEN (Kt=1), 0.5 IN. DIAM.,1.6 IN. GL
REF: WL-TR-91-4111 REPORT, WRIGHT LABORATORY OCT., 1991

AVDC HAT SHAPE:
SMOOTH SPECIMEN (Kt=1), 0.08 IN. THICK x 0.5 IN. WIDE_GL=1.25 IN.
ATC DWG L-7653

ESTIMATED R-CURVE (60 IN. WIDE PANEL, 0.1 IN. THICKNESS)
DERIVED FROM SMALL COUPON (KAHN TEAR)
2-PARAMETER FRACTURE TOUGHNESS MODEL

AL-SI-MG-MN CASTING ALLOY AND METHOD

PENDING RELATED APPLICATION

This application claims the benefit of U.S. Provisional Patent Application Ser. No. 60/361,019 filed on Feb. 28, 2002 and entitled "An Al—Si—Mg—Mn Casting Alloy and Method", the disclosure of which is fully incorporated by reference herein.

FIELD OF THE INVENTION

This invention relates to aluminum-based alloys. More particularly, this invention relates to improved Al casting alloys. The invention further relates to an Al—Si—Mg—Mn alloy that outperforms 357 aluminum, yet may be cast by various die casting methods, including high pressure vacuum die casting, for making improved aerospace parts therefrom.

BACKGROUND OF THE INVENTION

Sand or low-pressure permanent molds have been traditionally used to produce aerospace castings from 357 aluminum alloys. As registered with the Aluminum Association, alloy 357 includes: 6.5 to 7.5 wt. % silicon, up to 0.15 wt. % iron, up to 0.05 wt. % copper, up to 0.03 wt. % manganese, 0.45 to 0.6 wt. % magnesium, up to 0.05 wt. % zinc, up to 0.2 wt. % titanium and 0.04–0.07 wt. % beryllium, the balance aluminum. Subsequent to this registration of alloy 357, many aluminum producers have been working hard to avoid the addition of beryllium to this casting alloy for a variety of reasons. A family of 357-like alloys has since evolved. Yet, casting certain shaped parts from any of existing 357 alloy family members has proved troublesome.

The limitations of casting 357-like Al alloys via known processes include but are not limited to: maximum wall thicknesses castable, dimensional stability and surface finish. Long solution heat treat (or "SHT") times, for example, are needed to "spheroidize" the Si particles of a 357-like aluminum to achieve adequate mechanical properties, partially due to the generally slower solidification rate for this alloy/alloy family from traditional casting processes. Although known high-pressure die casting practices may produce thin-walled parts with good dimensional stability and surface finish, such parts cannot be heat-treated due to the high gas contents resulting from these die casting practices.

For some time, Alcoa has been practicing its proprietary vacuum die casting process (or "AVDC"). The process is an optimized outgrowth of the Vacural-Process using Muller-Weingarten casting machines, among other subtleties. After closing the die halves, air is evacuated through the die. The same vacuum is used to draw molten metal into the die's filling chamber. As compared to some other known vacuum die casting processes, Alcoa's AVDC is of very high quality and usually yields an extremely low porosity in the resultant castings.

A serious drive exists to lessen aircraft manufacturing costs. AVDC poses an economical means to reduce aerospace piece counts and decrease assembly costs by making it possible to design, make and use monolithic cast structures. AVDC offers airframe manufacturers excellent dimensional tolerances and consistency, superior surface quality—i.e. no need for chills, very little part-to-part and/or lot-to-lot variations in mechanical properties and a near guarantee of no weld repair.

To date, AVDC has been used to make heat-treatable, low gas content parts for the automotive industry. When high-pressure, die casting processes have been used to make other parts, including aerospace components, from 357 or 357-like aluminum alloys, die soldering and sticking issues have arisen. This invention aims to provide a new casting alloy composition that will reduce or eliminate soldering/sticking problems in AVDC and other high pressure, vacuum die casting practices.

SUMMARY OF THE INVENTION

This invention consists of an improved Al—Si—Mg—Mn casting alloy that consists essentially of: about 6.0–9.0 wt. % silicon, about 0.2–0.8 wt. % magnesium, about 0.1–1.2 wt. % manganese, less than about 0.15 wt. % iron, less than about 0.3 wt. % titanium and less than about 0.04 wt. % strontium, the balance aluminum. On a preferred basis, this invention casting alloy is substantially copper-free, chromium-free and beryllium-free. More preferably, this alloy consists essentially of: about 6.5–8.0 wt. % silicon, about 0.45–0.7 wt. % magnesium, about 0.1–0.5 wt. % manganese, less than about 0.15 wt. % iron and less than about 0.2 wt. % titanium, the balance aluminum.

The aforesaid composition can be subjected to known or subsequently developed practices for making die cast, squeeze cast and/or semi-solid metal formed parts thereform, typically for the aerospace industry. Such castings are preferably solution heat-treated at about 950–1020° F., for about 10–45 minutes, before being cold or warm water quenched (at one or more temperatures between about 70–170° F.), then artificially aged for a preferred 1 to 5 hours or more at about 320–360° F. to achieve adequate properties for aerospace applications.

DESCRIPTION OF PREFERRED EMBODIMENTS

Figure 1:
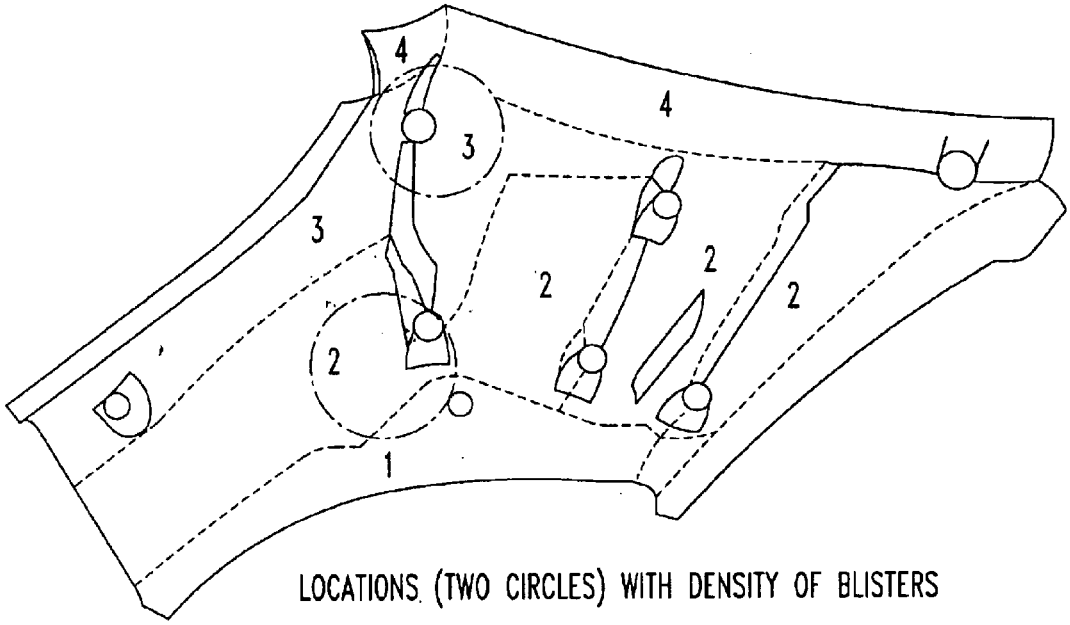
FIG. 1 is a sketch of a cast 357-type alloy part per the example hereinbelow with the two large, circled areas designating the highest density of blister defects observed thereon.

The invention described herein has the following main benefits/advantages over known 357 alloy castings: (a) Die soldering/sticking is minimized with the alloy composition of this invention; (b) larger, thin-walled parts with low gas contents and good surface finish can be produced with this alloy compostion by vacuum die casting, squeeze casting and/or semi-solid metal forming processes; and (c) because of the high solidification rates for typical die casting, squeeze casting, and semi-solid metal forming, the time required for solution heat treating and artificially aging parts cast from this alloy are significantly reduced compared to sand or low-pressure permanent mold casting.

EXAMPLES

A first casting trial used a composition consisting essentially of: 7.12 wt. % Si, 0.07 wt. % Fe, 0.61 wt. % Mg, 0.13 wt. % Mn, and 0.12 wt. % Ti, Al balance. The tensile properties per two comparative heat treatments performed on this composition were:

| Heat Treatment | TYS (ksi) | UTS (ksi) | Elong (%) |
|---|---|---|---|
| SHT @ 1000° F./20 min, HWQ (160° F.), Aged @ 340° F. for 3 hrs | 44.3 | 52.9 | 9 |
| SHT @ 1000° F./60 min, HWQ (160° F.), Aged @ 340° F. for 3 hrs | 43.7 | 51.9 | 6.3 |

A second trial was conducted with another composition consisting essentially of: 7.2 wt. % Si, 0.11 wt. % Fe, 0.16 wt. % Mn, 0.52 wt. % Mg and 0.12 wt. % Ti, balance Al. The measured tensile properties for those cast products, using only the shorter, 20 minute SHT as above, were:

| Heat Treatment | TYS (ksi) | UTS (ksi) | Elong (%) |
|---|---|---|---|
| SHT @ 1000° F./20 min, CWQ (70° F.) Aged @ 340° F. for 3 hrs | 38.8 | 48 | 11 |

Both trials were a success. With this new alloy composition, the dies were completely filled in their first shots. Some cast parts from these trials were x-rayed and found to be in excellent condition. Despite the relatively low Mg contents of this invention casting alloy, the mechanical properties for cast parts made therefrom exceeded expectations.

The lone technical issue encountered on these initial trials was minor blistering of the parts post heat-treatment. A standard production trial review was conducted to identify potential sources for this blistering. It is now believed that such blistering should be reduced and/or eliminated by reducing the amount of die lubricant used. These early test trials employed more lubricant than was needed in order to mitigate die wear and tear.

Comparison with Heat Treated 357 Alloy AVDC Parts

Various AVDC parts were cast from a 357 type aluminum alloy that was made Be-free. Those parts were subjected to the following heat treatment conditions: (1) solution heat treating at about 1000–1010° F. for 20 minutes; (2) cold water quenching at about 70° F.; (3) naturally aging at room temperature for about 1 hour (to approximate the delay typically associated with commercial, straightening operations; and finally: (4) artificially aging at about 340° F. for 3 hours.

The target versus actual compositions for the aforesaid 357-like alloy comparison measured as follows:

| Element (wt. %) | D357 Limits | Actual (avg. during trial) |
|---|---|---|
| Si | 6.5–7.5 | 7.2 |
| Fe | 0.12 | 0.11 |
| Be | 0.04–0.07 | 0 |
| Mn | 0.10 | 0.16 |
| Mg | 0.55–0.60 | 0.52 |
| Ti | 0.10–0.20 | 0.12 |

Blisters were observed on these 357-like cast parts after solution heat-treating at either 1000 or 1010° F. Table 1 that follows summarizes the size and location of these blisters by part number. The shape of this cast part is sketched in accompanying FIG. 1, with the large circled areas designating the highest density of blister defects observed thereon.

TABLE 1

Size and location of the blisters on 357-like parts

| Part # | Total # of Blister | Size (mm)/(Position) per FIG. 1 |
|---|---|---|
| | | SHT @ 1000° F. |
| 18 | 2 | 1/(4), 1(4) |
| 19 | 2 | 1/(3), 1/(3) |
| 21 | 3 | 2/(3), 1/(3), 1/(4) Part distorted, Cut for TYE |
| 31 | 7 | 2/(3), 2/(3), 1/(3), 2/(1), 2/(4), 2/(4), 1/(4) |
| 33 | 6 | 2/(2), 1/(2), 2/(3), 1/(3), 1/(4), 1/(4) |
| 35 | 4 | 2/(2), 1/(2), 1/(4), 1/(4) |
| 37 | 9 | 3/(4), 2/(2), 2/(2), 1/(2), 1/(2), 2/(3), 2/(3), 2/(3), 2/(3) |
| | | SHT @ 1010° F. |
| 20 | 4 | 3/(3), 2/(3), 1(2), 1(2) |
| 22 | 1 | 5/(2 rib) |
| 23 | 2 | 3/(3), 2/(2) |
| 24 | 2 | 3/(2), 1/(2) |
| 28 | 3 | 2/(2), 2/(2), 2/(2) |
| 29 | 2 | 1/(3), 1/(4) |
| 40 | 7 | 4/(3), 4/(3), 4/(2), 4/(2), 2/(2), 2/(2), 1/(2), Cut for TYE |

From these tests, it was noteworthy that blistering appeared to get worse with increasing part number. Part castings with numbers less than 30 had fewer, small blisters. The number and size of part blisters increased with cast numbers in the 30's. Parts with casting numbers in the 40's and 50's generally had the highest number of blisters.

Blistering was not strongly affected by SHT temperature (1000 versus 1010° F.), though. The blistering of these 357-like parts also concentrated in two localized regions (per the circled regions of FIG. 1). Hydrogen content analyses were conducted in the blistered areas on part #53. The results of these analyses are given in following Table 2 along with typical hydrogen contents of an AVDC cast part using optimized processes and two other comparative casting alloys: C448 (Al—Si) & C446 (Al—Mg).

TABLE 2

Hydrogen content of the AVDC parts

| Alloy | "357"-1 | "357"-2 | C448 (typical) | C446 (typical) |
|---|---|---|---|---|
| Hydrogen Content (ml/100 g) | 19 | 7.8 | 0.5–0.8 | 0.8–1.2 |

It is evident that the blistered areas of these 357 comparative parts had at least one order of magnitude hydrogen content higher than a typical AVDC part.

Figure 2:
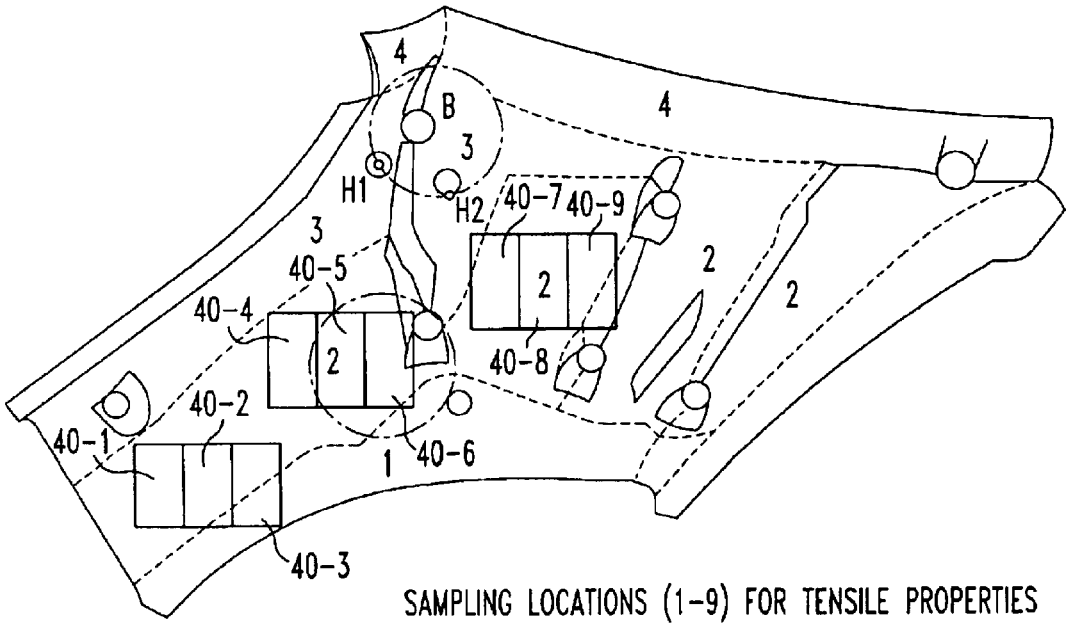
FIG. 2 is a sketch of that same alloy part for showing where sampling locations 1–9 were taken for performing tensile property evaluations thereon.

Two other 357-like cast parts, #21 and #40, were cut for performing mechanical property evaluations thereon. The SHT temperature was 1000 and 1010° F. for part #21 and part #40, respectively. After solution heat treatment, both parts were quenched in cold water (~70° F.), naturally aged at room temperature for 1 hour, and artificially aged at 340° F. for 3 hours. The tensile properties at various locations shown in accompanying FIG. 2 are given in following Table 3.

TABLE 3

Tensile Properties of AVDC "357" T6 temper

| Cast No. | Location | TYS MPa/ksi | UTS (MPa)/(ksi) | E % | Remark |
|---|---|---|---|---|---|
| 21 | 1 | 266/38.6 | 330/47.8 | 6 | |
| 21 | 2 | 265/38.4 | 331/47.9 | 10 | |
| 21 | 3 | 269/39.0 | 330/47.8 | 12 | |
| 21 | 4 | 266/38.5 | 329/47.7 | 12 | |
| 21 | 5 | 266/38.6 | 331/47.9 | 11 | |
| 21 | 6 | 266/38.6 | 327/47.4 | 10 | |
| 21 | 7 | 274/39.7 | 335/48.6 | 11 | |
| 21 | 8 | 271/39.3 | 335/48.6 | 14 | |
| 21 | 9 | 267/38.7 | 335/48.5 | 12 | |
| 40 | 1 | 277/40.1 | 336/48.7 | 6 | |
| 40 | 2 | 266/38.5 | 349/50.6 | 7 | |
| 40 | 3 | 268/38.9 | 344/49.9 | 6 | |
| 40 | 4 | 275/39.8 | 328/47.6 | 4 | Blister area |
| 40 | 5 | 268/38.6 | 328/47.6 | 4 | Blister area |
| 40 | 6 | — | 123/17.8 | — | Blister area |
| 40 | 7 | 298/43.2 | 353/51.1 | 9 | |
| 40 | 8 | 289/41.9 | 351/50.9 | 9 | |
| 40 | 9 | 271/39.3 | 355/51.4 | 9 | |

There exist several theories on what may have caused the blistering on these 357-like AVDC parts. Among them are: improper degassing, low vacuum in the die chamber, poor die design, too much lubricant, etc. The blisters found in the "357" parts are believed to have originated from the entrapment of excess water base lubricant based on the following evidence: (a) blistering got noticeably worse after casting #30. This coincides with the number at which the test trial operator increased the amount of lubricant to reduce an anticipated die-sticking tendency. Afterwards, the amount of applied lubricant was found to be ~200% of that used for a typical C448 cast part; and (b) the blistering was localized and followed surface lubricant flowing marks. This is a typical phenomenon of blistering from entrapped lubricant. It should also be noted that blistering was not detected in the sampling areas of part #21 (FIG. 2), while numerous large blisters (~4 mm) were found in the region 2 of part #40.

Two items appear to have affected the mechanical properties of these comparative 357 like parts: a relatively low Mg-content and the aforementioned blistering. With the invention alloy, therefore, a relatively higher Mg-content of 0.55–0.60 wt. % will be more preferred going forward. Further with respect to observed "mechanicals", part #21 had much more consistent tensile properties than part #40. Part #21 also showed good ductility (% Elongation) although its strength values fell a bit short of 40/50 ksi. Strengths generally increased by using the increased SHT temperature, from 1000° F. for part #21 versus the 1010° F. SHT temperature for part #40. By analogy to these 357-like results, it is believed that an aluminum casting of the invention alloy should be very capable of achieving consistent mechanical properties throughout the whole part, especially at the more preferred Mg levels described above.

Figure 3:
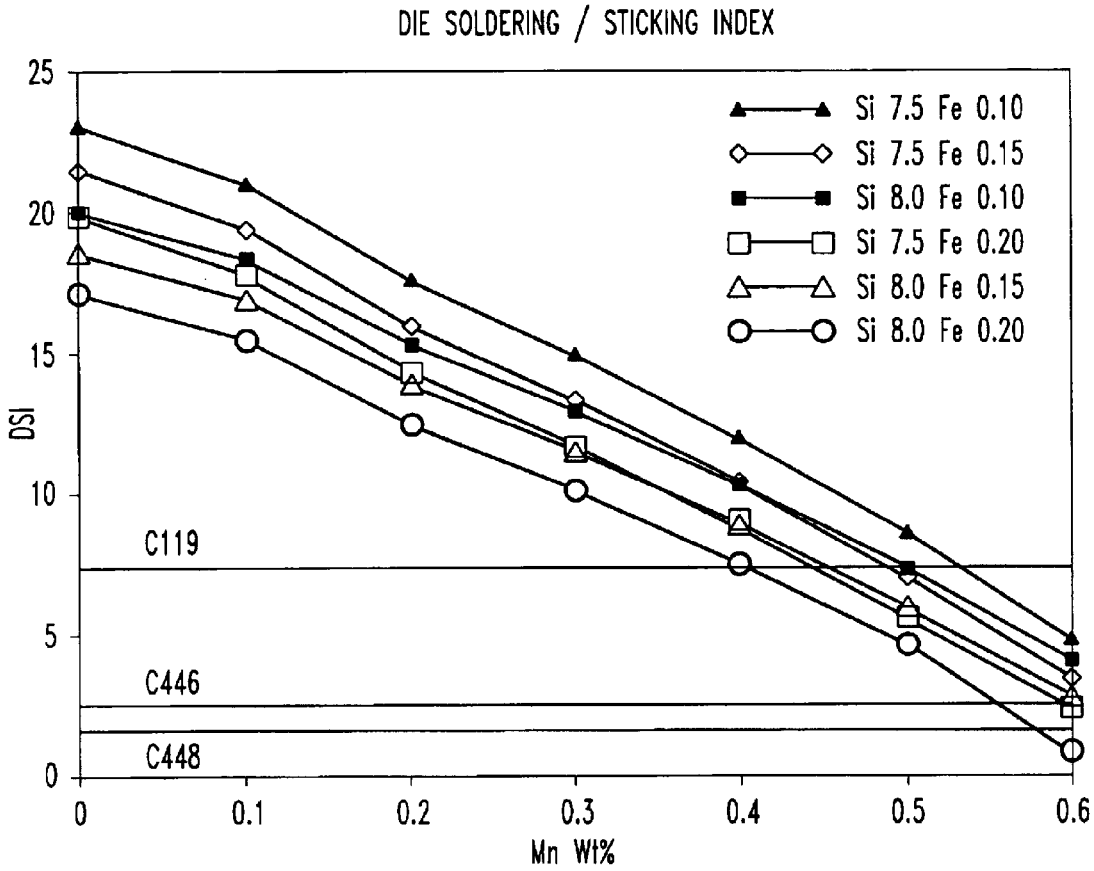
FIG. 3 is a graph depicting the relative die soldering/sticking index (or DSI) observed versus manganese content for the various Al—Si—Fe alloy compositions identified in the upper right key of this graph.

As the "357" alloy was designed a while back for sand or permanent mold casting, there was no mechanism for stopping this alloy from interacting with a bare steel die during casting. A die soldering/sticking tendency, strongly related to alloy composition, was readily observed. To better quantify this tendency, a die soldering/sticking index was developed. The lower the number value for that index, the lower the tendency for an alloy composition to experience die soldering/sticking. Potential C-alloy composition ranges of elements Si, Fe, and Mn were evaluated using the die soldering/sticking index. Accompanying FIG. 3 shows the results along with the indices of the incumbent alloys, C448, C446, and C119. From that charted data, a composition more closely approaching 8.0 wt. % Si, 0.15 wt. % Fe, and 0.45 wt. % Mn should better match the performance of an existing cast Al alloy in terms of die soldering/sticking tendencies.

For the invention alloy described herein, the die soldering/sticking tendency should be more of a moot issue as potential aerospace applications are not high volume especially when compared to their cast automotive counterparts. Die life will also be correspondingly less critical. And so long as aerospace parts cast from this new alloy can be ejected from a die, there should be less need to overuse die lubricants to suppress soldering/sticking.

Finally, using a hat-shaped die, a standard test part with 0.08–0.12 inch (2–3 mm) wall thickness was fabricated from the invention alloy on a prototype AVDC caster. One hundred castings of that alloy were made in a single run and subsequently SHT'd, quenched and aged to a T6 temper. Duplicate tensile tests were performed on six different castings from that lot of 100, resulting in the following average mechanical test properties:

51.3 ksi (354 Mpa) Ultimate Tensile Strength 43.1 ksi (297 Mpa) Tensile Yield Strength and 8.2% Elongation.

Figure 4:
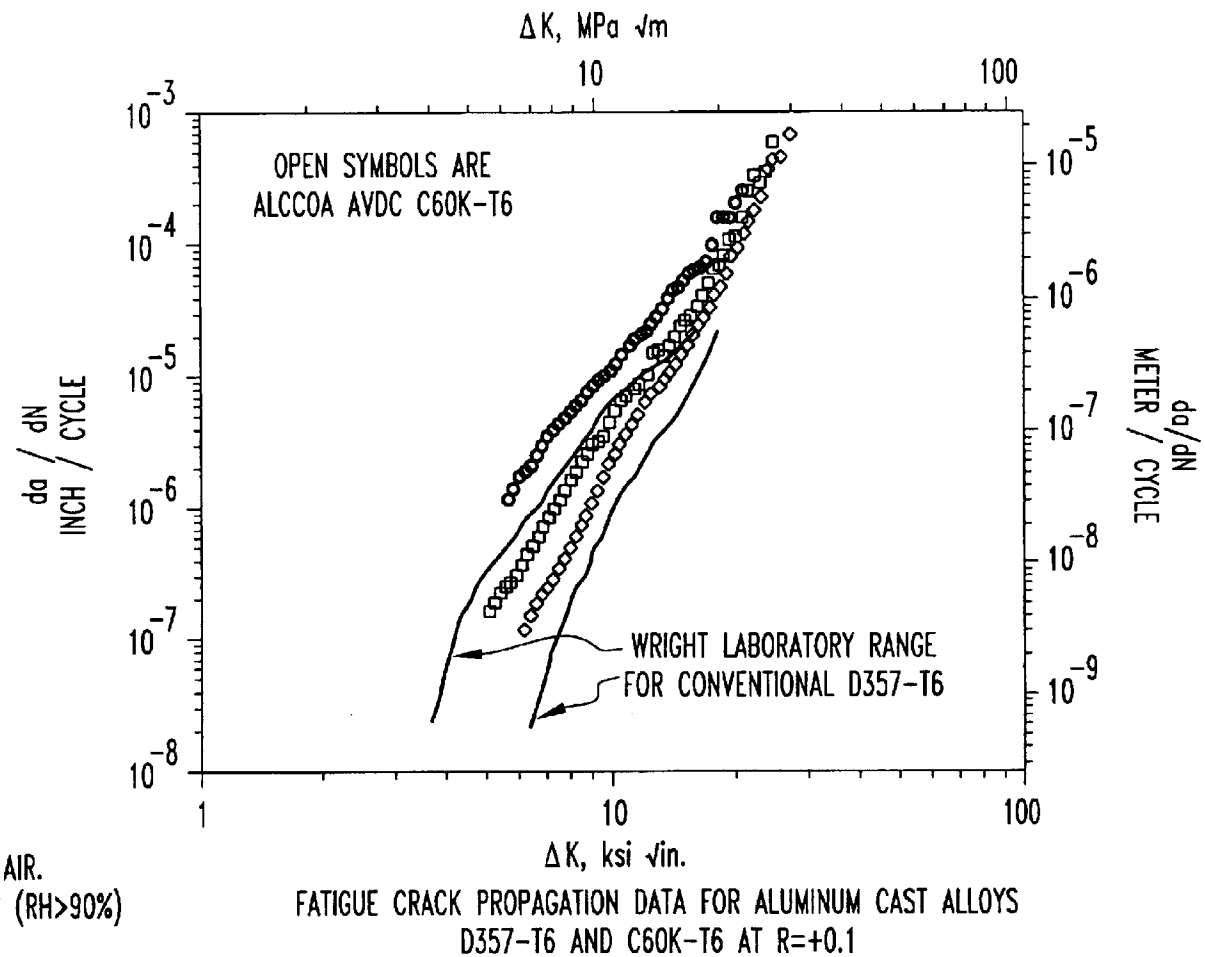
FIG. 4 is a graph comparing Fatigue Crack Growth Propagation Data for a 357 alloy casting (in lab air) versus that for a hat-shaped casting of the invention alloy (in high humidity air), both T6 aged.
Figure 5:
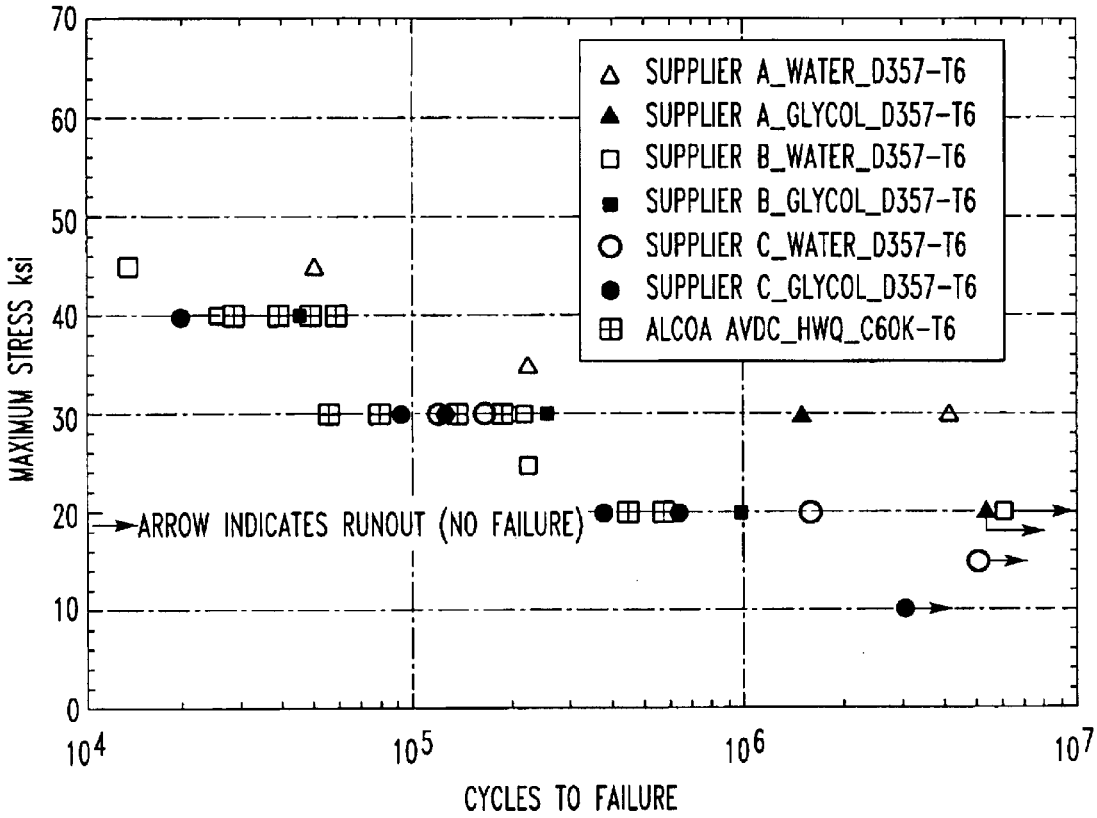
FIG. 5 is a graph comparing Smooth Axial Stress Fatigue Data of 357-T6 castings versus the Invention alloy using water versus glycol based quenches for the prior art and a hot water quenched, invention alloy hat-shaped casting.
Figure 6:
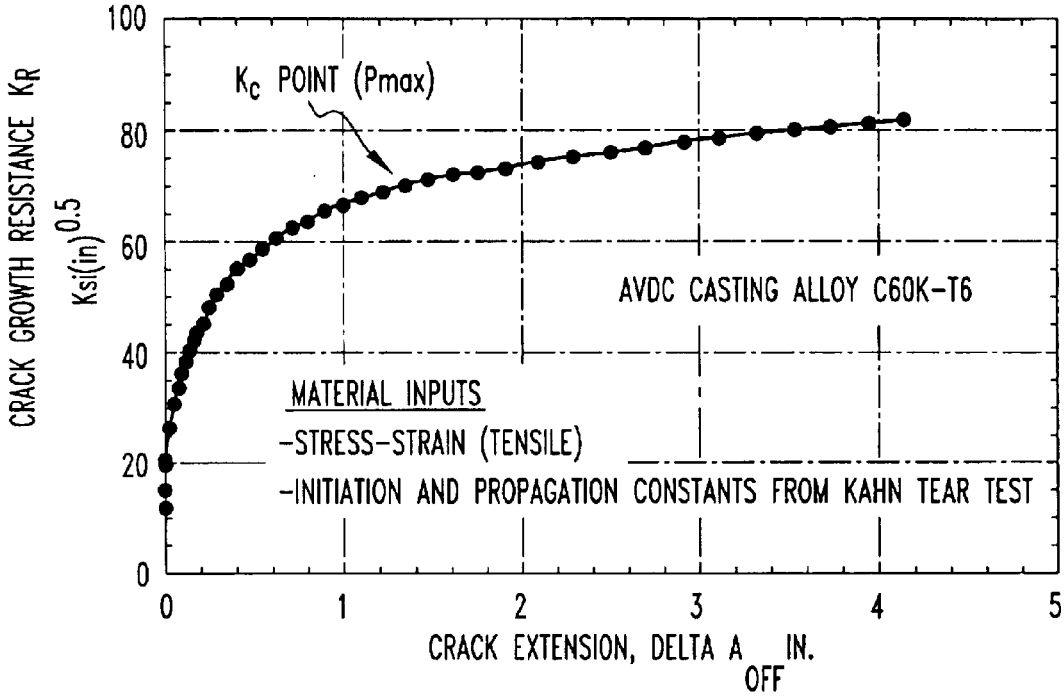
FIG. 6 is a graph depicting the estimated R-curve crack growth resistance of the Invention alloy as derived from a small coupon (Kahn Test) 2-Parameter Fracture Toughness Model.

Per accompanying FIG. 4, fatigue characterizations of the invention alloy showed comparable performance results to 357-T6 baseline data. Referring now to FIG. 5, toughness estimates for the composition of this invention, from Kahn tear tests, yielded ~80 Mpa-m$^{1/8}$. Finally, FIG. 6 shows the maximum stress values, of smooth axial stress fatigue comparisons, for various water or glycol quenched 357-T6 castings versus a hat-shaped Invention alloy casting, also aged per T6 type tempering practices.

Having described the presently preferred embodiments, it is to be understood that the invention may be otherwise embodied within the scope of the appended claims.

What is claimed is:

1. An aluminum casting alloy composition that consists essentially of: about 6.0–9.0 wt. % silicon, about 0.2–0.8 wt. % magnesium, about 0.1–1.2 wt. % manganese, less than about 0.15 wt. % iron, less than about 0.3 wt. % titanium and less than about 0.04 wt. % strontium, the balance aluminum with incidental elements and impurities, the alloy being substantially copper-free, chromium-free and beryllium-free.

2. The casting alloy of claim 1 which contains about 6.5–8.0 wt. % silicon.

3. The casting alloy of claim 1 which contains about 0.45–0.7 wt % magnesium.

4. The casting alloy of claim 1 which contains about 0.1–0.5 wt. % manganese.

5. The casting alloy of claim 1 which contains less than about 0.2 wt. % titanium.

6. The casting alloy of claim 1 which contains about 6.5–8.0 wt. % silicon, about 0.45–0.7 wt. % magnesium, about 0.1–0.5 wt. % manganese, less than about 0.15 wt. % iron and less than about 0.2 wt. % titanium.

7. The casting alloy of claim 1 which is high pressure die cast to make aerospace structural parts therefrom.

8. The casting alloy of claim 1 which is squeeze cast to make aerospace structural parts therefrom.

9. The casting alloy of claim 1 which is semi solid formed into an aerospace structural part.

10. The casting alloy of claim 1 which has an ultimate tensile strength greater than about 45 ksi.

11. The casting alloy of claim 10 which has an ultimate tensile strength greater than about 50 ksi.

12. The casting alloy of claim 1 which is substantially blister-free.

13. An aerospace structural component cast from an alloy composition that consists essentially of: about 6.0–9.0 wt. % silicon, about 0.2–0.8 wt. % magnesium, about 0.1–1.2 wt. % manganese, less than about 0.15 wt. % iron, less than about 0.3 wt. % titanium and less than about 0.04 wt. % strontium, the balance aluminum with incidental elements and impurities, the alloy being substantially cooper-free, chromium-free and beryllium-free.

14. The aerospace component of claim 13 wherein said composition contains about 6.5–8.0 wt. % silicon, about 0.45–0.7 wt. % magnesium, about 0.1–0.5 wt. % manganese, less than about 0.15 wt. % iron and less than about 0.2 wt. % titanium.

15. The aerospace component of claim 13 which is high pressure die cast.

16. The aerospace component or claim 13 which is squeeze east.

17. The aerospace component of claim 13 which is semi solid formed.

18. The aerospace component of claim 13 which has an ultimate tensile strength greater than about 45 ksi.

19. The aerospace component of claim 18 which has an ultimate tensile strength greater than about 50 ksi.

20. The aerospace component of claim 13 which is substantially blister-free.

* * * * *

UNITED STATES PATENT AND TRADEMARK OFFICE

CERTIFICATE OF CORRECTION

PATENT NO. : 6,773,666 B2
DATED : August 10, 2004
INVENTOR(S) : Jen C. Lin et al.

It is certified that error appears in the above-identified patent and that said Letters Patent is hereby corrected as shown below:

Column 2,
Line 28, insert -- therefrom -- delete “thereform”.

Column 8,
Line 9, insert -- cast -- delete “east”.

Signed and Sealed this

First Day of November, 2005

JON W. DUDAS
*Director of the United States Patent and Trademark Office*